US010207890B2

(12) United States Patent
Kotzur

(10) Patent No.: US 10,207,890 B2
(45) Date of Patent: Feb. 19, 2019

(54) APPARATUS AND METHOD FOR WINDING COIL

(71) Applicant: REELEX Packaging Solutions, Inc., Patterson, NY (US)

(72) Inventor: Frank W. Kotzur, Carmel, NY (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 130 days.

(21) Appl. No.: 15/600,034

(22) Filed: May 19, 2017

(65) Prior Publication Data

US 2018/0334352 A1 Nov. 22, 2018

(51) Int. Cl.

| | |
|---|---|
| ***B65H 54/08*** | (2006.01) |
| ***B65H 54/12*** | (2006.01) |
| ***B65H 54/28*** | (2006.01) |
| ***B65H 55/04*** | (2006.01) |

(52) U.S. Cl.

CPC ..... *B65H 54/2884* (2013.01); *B65H 54/08* (2013.01); *B65H 54/12* (2013.01); *B65H 55/046* (2013.01); *Y10S 242/901* (2013.01)

(58) Field of Classification Search

CPC .... B65H 54/08; B65H 54/12; B65H 54/2818; B65H 54/2884; B65H 55/046; Y10S 242/901

See application file for complete search history.

(56) References Cited

U.S. PATENT DOCUMENTS

| | | | |
|---|---|---|---|
| 2,634,922 | A | 4/1953 | Taylor, Jr. |
| 2,767,938 | A | 10/1956 | Taylor, Jr. |
| 3,061,238 | A | 10/1962 | Taylor, Jr. |
| 3,178,130 | A | 4/1965 | Taylor, Jr. |
| 3,655,140 | A | 4/1972 | Gordon et al. |
| 3,747,861 | A | 7/1973 | Wagner et al. |
| 3,898,436 | A | 8/1975 | Pottebaum et al. |
| 4,057,203 | A | 11/1977 | Newman et al. |
| 4,057,204 | A | 11/1977 | Zajac |
| 4,085,902 | A | 4/1978 | Wagner |
| 4,238,084 | A | 12/1980 | Kataoka |
| 4,373,687 | A | 2/1983 | Zicko |
| 4,406,419 | A | 9/1983 | Kotzur |
| 4,523,723 | A | 6/1985 | Kotzur |

(Continued)

OTHER PUBLICATIONS

International Search Report of PCT/US18/33078 dated Aug. 7, 2018.

*Primary Examiner* — William E Dondero

(74) *Attorney, Agent, or Firm* — Gordon & Jacobson, P.C.

(57) ABSTRACT

An apparatus for winding filamentary material includes a mandrel rotatable about a spindle axis of rotation and a traverse reciprocating at a distance with respect to the spindle axis to wind the filamentary material in a figure-eight coil configuration with a payout hole extending radially from the inner to the outer wind of the coil. The apparatus includes a measurement device for measuring the diameter of the coil as it is being wound around the mandrel, and a controller for controlling the reciprocating movement of the traverse with respect to the rotation of the mandrel based on the measured diameter of the coil. The measurement device may include a first sensor configured to measure a length of filamentary material wound about the mandrel and a second sensor configured to measure an angular displacement of said mandrel during the winding of the length of filamentary material about said mandrel.

17 Claims, 5 Drawing Sheets

(56) References Cited

U.S. PATENT DOCUMENTS

| | | | |
|---|---|---|---|
| 4,884,764 | A | 12/1989 | Hill |
| 4,920,274 | A | 4/1990 | Jensen |
| 5,023,820 | A | 6/1991 | Baum |
| 5,150,789 | A | 9/1992 | Bass |
| 5,150,852 | A | 9/1992 | Hunt et al. |
| 5,470,026 | A | 11/1995 | Kotzur |
| 5,499,775 | A | 3/1996 | Vander Groef |
| 5,678,778 | A | 10/1997 | Kotzur et al. |
| 5,823,460 | A | 10/1998 | Hermanns |
| 5,979,812 | A | 11/1999 | Kotzur et al. |
| 7,249,726 | B2 | 7/2007 | Kotzur |
| 8,079,539 | B2 | 12/2011 | Huang et al. |
| 2016/0083217 | A1 | 3/2016 | Kotzur et al. |

APPARATUS AND METHOD FOR WINDING COIL

BACKGROUND

1. Field

This application relates to apparatus and methods for winding coils. More particularly, this application relates to an apparatus and methods for controlling coil winding parameters.

2. State of the Art

U.S. Pat. No. 2,634,922 to Taylor describes the winding of flexible wire, cable or filamentary material around a mandrel in a figure-eight pattern such that a package of filamentary material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package, without imparting a rotation in the wire around its axis (i.e., twisting), and without kinking. This provides a major advantage to the users of the wire. Coils that are wound in this manner and dispense from the inside-out without twists, tangles, snags or overruns are known in the art as REELEX (a trademark of Reelex Packaging Solutions, Inc.) -type coils. REELEX-type coils are wound to form a generally short hollow cylinder with a radial opening formed at one location in the middle of the cylinder. A payout tube may be located in the radial opening and the end of the wire making up the coil may be fed through the payout tube for ease in dispensing the wire.

U.S. Pat. No. 5,470,026 describes a coil with a payout hole that has a larger angular opening in the first layer and decreases in angular size in layers wound around inner layers, and also describes a correction of a payout hole angle due to a natural shift in the coil layers during the winding of the coil. The decrease in angular size controls a parameter referred to as "hole taper" and the correction of the payout hole angle controls a parameter referred to as "hole shift". Previously, hole taper and hole shift were calculated based on a predicted diameter of the coil as it is being wound. The assumed or predicted diameter of the coil was based on counting the number of layers of wire laid down on a winding mandrel and multiplying the number by the diameter of the wire, hereinafter referred to as a "per-layer" method or approach.

U.S. Pat. No. 7,249,726 describes another coil winding parameter referred to as "density". Reelex coils are produced by placing a plurality of figure-eight's radially around the circumferences of the coil using coil parameters referred to as "gains" or "traverse speed offsets" or "speed offsets". If, for example, a coil is produced using speed offsets that place the figure-eights 30° apart, then these figure-eights will be 2.094 inches apart on an 8-inch diameter mandrel and 4.188 inches apart when the coil diameter reaches 16 inches. As a result, the coil is less "dense", in terms of number of figure-eights, in the outer (radially relative to the center of the coil) layers of the coil. The density parameter has been used to control (i.e., reduce) the speed offset after each layer of the coil is wound so that the coil can be formed with increasing numbers of figure-eights as the number of layers of the coil increases. As a result, the angular space between figure-eights decreases with increasing coil layers counts, increasing the density in layers after the first layer.

When using prior methods of winding filamentary material into coils, each of the parameters, known to adjust the hole shift, density, and hole taper parameters after the winding of each layer of the coil to obtain a relatively compact coil with a relatively straight (radially) payout hole of relatively uniform diameter. The amount of adjustment made to the hole shift, density, and hole taper parameters at each layer are based on a predicted coil diameter based on the diameter of the filamentary material being wound and the layer number in the coil.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Actual measurements of the coil diameter are derived and tracked during a coil winding process. The actual measurement of the coil diameter can be used with existing functional relationships between coil diameter, speed offset, hole shift, density, and hole taper to control the winding of the coil. However, by measuring the actual coil diameter at any point during winding, the determinations of the other winding parameters are not collectively affected as they are when predictions of the coil diameter are used. Thus, by measuring the actual diameter of the coil, it is possible to vary each winding parameter independently to achieve a specific coil configuration.

According to one aspect of the disclosure, further details of which are provided herein, an apparatus for winding filamentary material includes a mandrel rotatable about a spindle axis of rotation and a traverse reciprocating at a distance with respect to the spindle axis to wind the filamentary material in a figure-eight coil configuration with a payout hole extending radially from the inner to the outer wind of the coil. The apparatus includes a measuring device for measuring the diameter of the coil as it is being wound around the mandrel, and a controller for controlling the reciprocating movement of the traverse with respect to the rotation of the mandrel based on the measured diameter of the coil to wind the filamentary material on the mandrel in the coil of a figure-eight configuration to form the radial payout hole having a constant diameter. The measurement device includes a first sensor configured to measure a length of filamentary material wound about the mandrel, and a second sensor configured to measure an angular displacement of the mandrel corresponding to the length of filamentary material wound about the mandrel.

In one embodiment, the first sensor includes an encoder configured to generate a series of pulses corresponding to the length of filamentary material wound about the mandrel. In one embodiment, the second sensor includes an encoder configured to generate a series of pulses corresponding to the angular displacement of the mandrel. In one embodiment, the measurement device includes a diameter determination unit for determining the diameter of the coil based on the length of filamentary material wound about the mandrel measured by the first sensor and the angular displacement of the mandrel measured by the second sensor.

In one embodiment, the controller is configured to wind the filamentary material on the mandrel in the coil of a figure-eight configuration to form the radial payout hole having a straight configuration. In one embodiment, the controller is configured to wind the filamentary material on the mandrel in the coil of a figure-eight configuration such that the number of figure-eights in each layer of the coil increases from an inner wind of the coil to an outer wind of the coil. In one embodiment, the number of figure-eights in each layer increases linearly from the inner wind of the coil to the outer wind of the coil. In one embodiment, the number of figure-eights in each layer increases non-linearly from the inner wind of the coil to the outer wind of the coil.

According to another aspect, further details of which are described herein, a method of winding filamentary material on a mandrel rotatable about a spindle axis of rotation and a traverse reciprocating at a distance with respect to the spindle axis to wind the filamentary material in a figure-eight coil configuration with a radial payout hole extending radially from the inner to the outer wind of said coil, includes controlling the rotation of the mandrel about the spindle axis of rotation to wind filamentary material about the mandrel. Also, the method includes measuring the diameter of the coil as the filamentary material is being wound about the mandrel, and controlling, based on the measurement of the diameter, the reciprocating movement of the traverse with respect to the rotation of the mandrel to wind the filamentary material on the mandrel to form the radial payout hole having a constant diameter.

DETAILED DESCRIPTION

Figure 1:
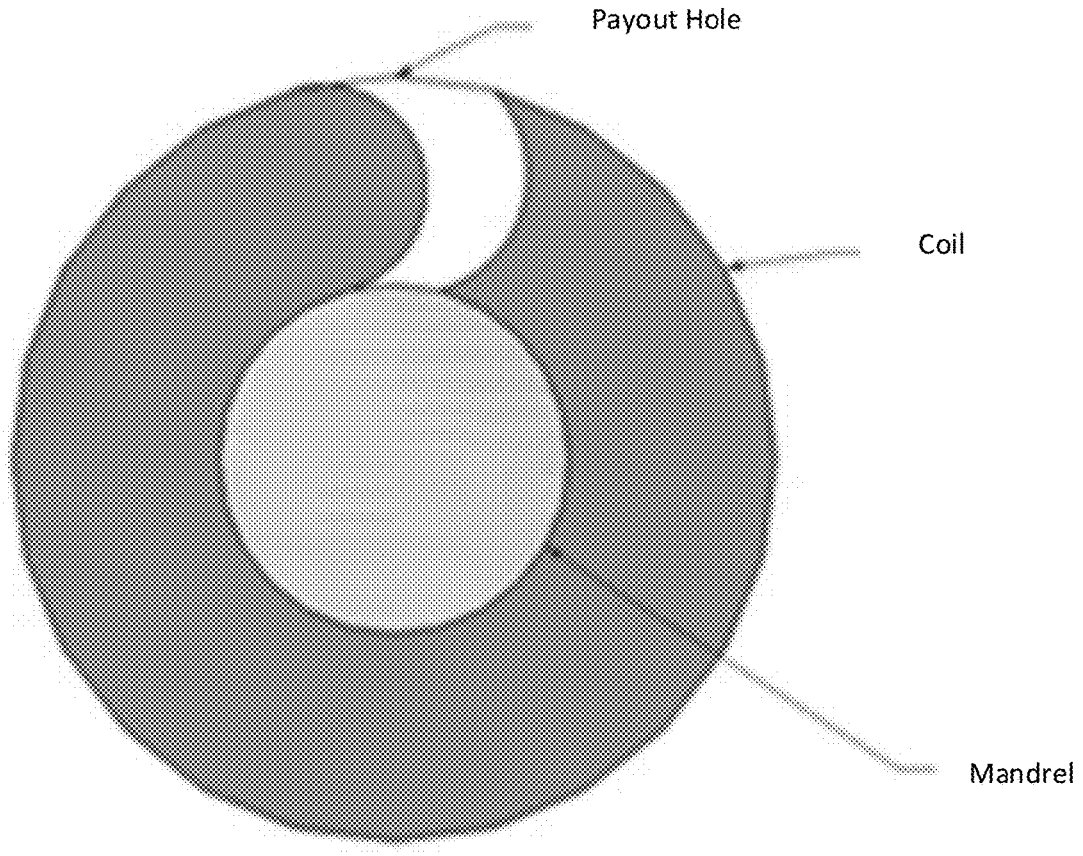
FIG. 1 illustrates a prior art coil formed where the payout hole has drifted.

Before describing an improved winding system, an understanding of some of the theory underlying the winding system is useful. As previously discussed, for winding a figure-eight coil, it is known to adapt the hole shift, density, and hole taper. The amount of adjustment at each layer has been based on the predicted coil diameter. However, the coil diameter is predicted based on an inaccurate assumption that the coil diameter increases linearly with each layer of the coil (assumes that each layer stacks neatly on a preceding inner layer) and by a predictable amount based only on the diameter of the wire being wound. That assumption is inaccurate for various reasons based on the construction of the wire being wound and because the assumption does not hold when the above-noted parameters deviate from a specific range in which they more accurately predict coil diameter.

For example, the nature of the filamentary material being wound ("stiffness", slipperiness, compressibility), line tension, and the traverse speed offset can be factors causing deviation between the predicted coil diameter and the actual coil diameter. In the case of the speed offset, increasing the speed offset can result in a reduction in the number of figure-eights being wound in each layer of the coil, such that there may be open spaces in each layer that are occupied by figure-eights of outer layers (i.e., the layers do not stack neatly one upon the other in all instances). For example, if twelve figure-eights are wound on an 8-inch diameter mandrel in the first layer, the wound length can be calculated to be 50.27 feet (ignoring the space that would be used by the payout hole). The space between the figure-eights is 2.09 inches of circumference based on the twelve figure-eights (because twelve figure-eights translates to 30° spacing, which corresponds to 2.09 inches of circumference). Since the space between figure-eights is 2.09 inches, a reasonable assumption might be that the layer wound on top of this first layer might have enough foundation from the first layer allowing for the assumption that the next layer will sit at a larger diameter that is equal to the sum of the mandrel diameter plus twice the diameter of the filamentary material (i.e., the wire or cable). This allows for a calculation that the length of product wound in the next layer will be equal to another 50.27 feet+(2·pi·the number of figure-eights·2·the diameter of the filamentary material) feet. Therefore, if the product diameter is 0.3 inch, and 12 figure-eights are wound in the next layer, then the next layer will have 3.77 more feet (2·pi·12·2·0.3/12) than the layer immediately below it. However, if the first layer is wound with only five figure-eights, then the space between the figure-eights is in excess of 5 inches. This means that while the first layer is sitting on a solid mandrel, the second layer experiences long spans between the figure-eights below it where it is unsupported by filamentary material, and thus may be compressed inwardly when additional filamentary material is wound over it. In that case, the third layer will not have a solid foundation because the second layer will have little or no support. Further, because of the variability in the support of the second and third layers, it is difficult to know the actual diameter for the second and third layers, and the uncertainty in the diameter measurement grows as additional layers are wound and compress the layers below.

The foregoing situation is compounded even further with variations in winding line tension and product compressibility. Indeed, some filamentary materials compress relatively easily causing a material that might measure, say, 0.230 inch in diameter in an uncompressed state to compress or flatten to 0.210 inch, for example.

The following example illustrates the interplay of some of coil forming parameters and the formulas used in the prior art patents referenced herein. Table 1 below lists parameters used for the example.

TABLE 1

| | |
|---|---|
| Mandrel Diameter | 8 inches |
| Product Diameter | 0.25 inch |
| Traverse Speed Offset | 4.0% |
| Hole Size | 90° |
| Coil Length | 1000 feet |

Given the example parameters, based upon prior art calculations, a coil diameter of approximately 16.36 inches (about 16 layers of wound product) would be expected. If the traverse speed offset is doubled from 4% to 8% the number of figure-eights in each layer will be halved, therefore requiring more layers (about 27 layers) to completely wind the entire length of filamentary material. Specifically, in that case, the prior art Reelex formulas used to predict coil diameter would predict that the final coil diameter will be 21.71 inches. Empirically, however, this predicted diameter size change does not actually occur. Instead, wire line tension during winding radially compresses the coil so that the actual diameter of the coil is less than the predicted diameter.

Moreover, since the diameter of the coil is used as an input in determining the other parameters used to wind a coil, those parameters can also be affected by inaccuracies in the coil diameter, causing the coil to be wound with payout holes that are not radially aligned (payout hole may curve in the radial direction, as shown in FIG. 1) and/or with coils that have unexpected dimensions (final diameter may be smaller than predicted).

Using the parameters from the above example, if the payout hole needs to be shifted 64° from the beginning on an 8-inch diameter mandrel to its completion at 16 inches, the payout hole needs to be "corrected" or biased at the rate of approximately 4° per layer (or 16° per inch of coil wall). During winding the winding machine shifts the payout hole (or layers) at the end of the completion of each layer by 4°. However, if the speed offset is doubled to 8.0%, the payout hole will be shifted by 108° (27 layers·4° per layer). While this would be correct for a coil diameter of 21 inches, it is likely incorrect because the coil will probably be smaller than 21 inches due to line tension, as noted above. If it is assumed, based on past empirical evidence, that the actual finished coil has a diameter of 17.5 inches (instead of 21 inches), the proper total hole shift would be approximately 76°. However, if the shift is 4° per layer, this will result in a payout hole that is shifted approximately 32° too far. To compensate for this overshoot, one tendency is to use a somewhat lower hole shift value of 2.8° per layer over the 27 layers wound (27 layers·2.8°=75.6°).

Furthermore, due to the compressibility of the coil, while the first layer will have the payout hole in the correct place, the second layer will be close to the correct diameter and should have a shift of 4°, but will only have a 2.8° shift. Instead, the second layer might require a shift of 3.9°, rather than 2.8°. Somewhere in the winding process the required shift and the actual shift will be the same, after which the situation will reverse. If the hole shift is not adjusted during winding, the payout hole will first shift away from the traverse (instead of radially) and will continue to shift that way but with less and less shift until that point where the coil is growing in diameter at such a rate that an amount of 2.8° shift is the correct amount. It will then begin to slant toward the traverse. Thus, instead of a straight payout hole, the coil will have one that is bowed; first in the same direction that the coil was wound then in the opposite direction, as is shown in FIG. 1.

A similar issue exists using this per-layer approach when applied to hole taper. One issue related to hole taper is that when the payout hole is made smaller, the coil diameter is reduced slightly because there is increasing area of the coil to place the wound filamentary material. Reusing the parameters in Table 1 of the above example, if it is assumed that a starting payout hole angle size is 90°, then the opening created will have a diameter of 6.28 inches at the surface of the 8-inch mandrel, and would correspond to an opening size of 12.56 inches at a coil diameter of 16 inches. If it is desired to maintain a payout hole size that is 6.28 inches throughout the radial length of the payout hole, the payout hole angle size needs to be 45° when the coil diameter reaches 16 inches. However, based on theoretical calculations, the coil diameter will be smaller by about ½ inch. This would call for a slightly larger final payout hole angle size of 46.4°. By applying the same reasoning for hole taper that was applied to the hole shift and using a traverse speed offset of 8.0% the final payout hole angle size of about 34° can be calculated (for a 21-inch diameter coil). The payout hole angle needs to be reduced by 2.07° per layer over the 27 layers. However, the coil diameter will not be 21 inches—probably somewhere nearer 17 inches (an amount based on empirical evidence) considering the reduced diameter due to the hole taper—which means that the final payout hole angle size should be about 42°. The difference (8°) amounts to a payout hole that is about 1.18 inch of circumference smaller than it should be. Therefore, to end up with a payout hole of the proper size when the coil diameter reaches 17 inches requires a hole taper of about 1.78° per layer. Thus, use of the per-layer approach will create a payout hole that is correct at start, swells through the middle, and tapers back in as the coil winding process progresses. If the effects of hole shift are compounded with the effects of hole taper, the result is that the side of the hole closest to the traverse might start out straight then curve away from the traverse and then back again. The other side of the payout hole will slant even further out away from the traverse then back in the outer layers.

In the above examples the traverse speed offset has been kept constant throughout the coil winding process, which means that the radial spacing between each figure-eight is the same from layer to layer. The density parameter is related to the traverse speed offset in that the density parameter effectively adjusts (e.g., reduces) the traverse speed offset on a per-layer basis of the coil, therefore decreasing the radial spacing between the figure-eights as the number of layers of the coil increase during winding. The result is that more filamentary material is wound with each passing layer, not just because the coil diameter is larger with each layer but, also because the number of figure-eights is increasing as the coil grows in diameter. Thus, the coil is more "dense" than if the traverse speed offset were kept constant during winding. One impact of making the coil denser is that it reduces the number of layers needed to complete the coil and, therefore, it reduces the coil diameter, which, in-turn, alters the above-noted Reelex calculations for hole shift and hole taper. Furthermore, the coil grows more rapidly in the inner layers and more slowly with increasing coil diameter growth.

There are limitations with the prior implementation of density where the traverse speed offset is reduced proportionally by a constant factor with each layer. The problem is illustrated below. As described in U.S. Pat. No. 7,249,726 for a 3.0% traverse offset speed, the number of figure-eights that will be radially distributed around a first layer of coil will be 16.67 (1/(2·3%/100). The amount of filamentary material used about the payout hole is ignored for this explanation, because for this analysis, of interest is only the spacing between the figure-eights, in degrees, around the circumference of the coil (or mandrel). If a density factor of 0.2% is applied to the traverse speed offset, the second layer will be produced using a traverse speed offset of 2.8% (3%−0.2%). This produces the second layer with 17.8571 figure-eights. If the traverse speed offset is continually reduced by the density factor of 0.06 in the same manner, the number of figure-eights change with each layer as follows: 19.23, 20.83, 22.73, 25.00, 27.78, 31.25, 35.71, 41.67, 50.00, 62.50, 83.33, 125.00, 250.00.

Thus, the small 0.2% change in the speed offset caused by the 0.2% density factor has a much larger effect on the number of figure-eights in each layer as the number of layers increase. By the 15th layer, for example, the machine is using a traverse speed offset of only 0.2% and will be attempting to place 250 figure-eights in that layer. In addition, the equation for figure-eights becomes undefined for the sixteenth layer (denominator becomes zero). Thus, the method of controlling density by reducing the speed offset by a constant for each layer can produce a runaway condition in the calculations. The most glaring inconsistency can be seen in the above example of layer 15. With 250 figure-eights in that layer (assuming 15 inch coil diameter) the amount of material wound in that layer alone would be almost 2000 feet which makes no sense since the calculations made in these examples are for 1000 foot coils.

Figure 2:
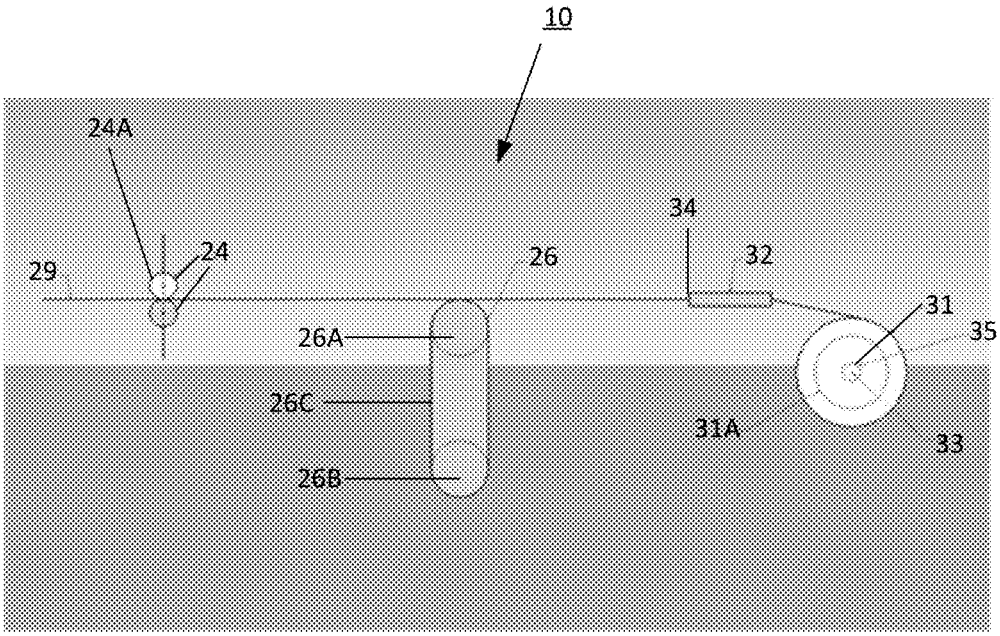
FIG. 2 is a schematic representation of a portion of an embodiment of a winding system in accordance with an aspect of the present disclosure.
Figure 3:
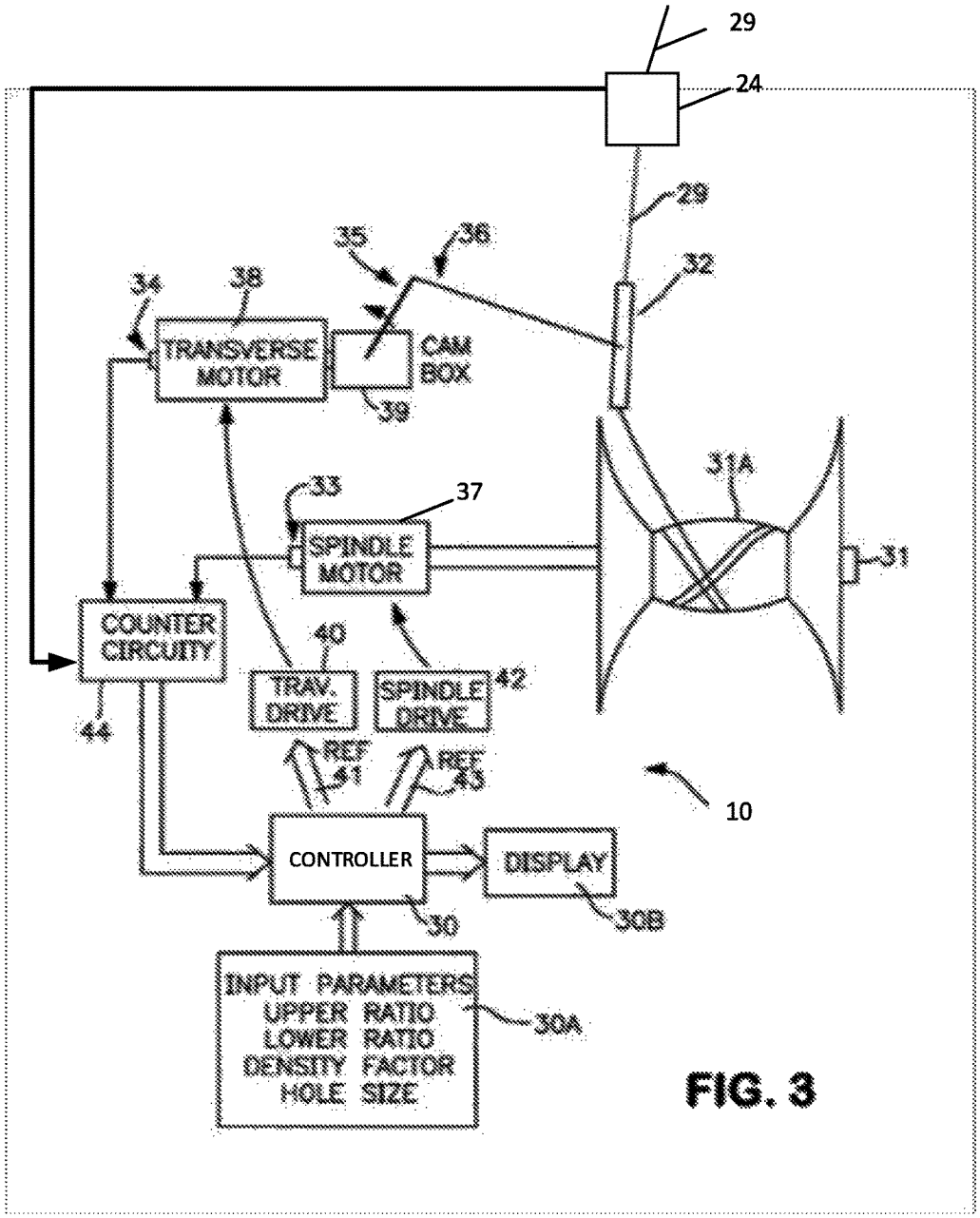
FIG. 3 shows, in block diagram format, an embodiment of a winding apparatus in accordance with an aspect of the disclosure.

These problems and issues are overcome with the system 10 of FIGS. 2 and 3. FIG. 2 shows a schematic of a portion of a winding system 10 in accordance with an aspect of the present disclosure. The system includes a mandrel 31A driven by a spindle 31 for winding a filamentary material 29 (e.g., wire or cable) into a coil 35. The system 10 includes a length counter 24, a reciprocating traverse 32, and an optional spring-loaded buffer 26. The filamentary material 29 being wound passes through the length counter 24, the buffer 26, and the traverse 32 when the mandrel 31A is driven by the spindle 31 (clockwise in FIG. 2). The traverse 32 reciprocates (in and out of the page of FIG. 2 and right-to-left-to-right in FIG. 3) while the mandrel 31A rotates about its axis (e.g., clockwise in FIG. 2) so that the filamentary material 29 is laid down in a figure-eight pattern about the mandrel 31A.

The counter 24 may include a pair of wheels 24A or pulleys between which the filamentary material 29 passes, causing the wheels to rotate about their respective axes. The wheels 24A have a known, fixed circumference, such that each revolution of the wheels 24A corresponds to a length of filamentary material 29 paid out equal to the circumference of one of the wheels 24A. In one embodiment, the length counter 24 includes a deterministic high priority hardware encoder interrupt that creates and sends a length counter pulse or signal to a controller 30 (FIG. 3), which acknowledges the signal or pulse within microseconds of its arrival. The length counter 24 provides pulses, that can be of any reasonable resolution, corresponding to a length of the filamentary material 29. By way of example only and not by way of limitation, the resolution may be 1 to 200 pulses per linear foot of filamentary material 29. The encoder used may be similar to a Model TR1 encoder from Encoder Products Company of Sagle, Idaho. In one embodiment, an incremental shaft encoder may be attached to one of the wheels 24A. Also, in one embodiment, a Hall Effect device may be used with magnets mounted to the rotating shaft of the wheels 24A. Further, laser-type length counters using Doppler technology may be used as well. Scaling factors may be applied to these pulses to provide more accurate measurements. In the following example, the resolution used will be four pulses per linear foot. Thus, each interrupt pulse that is recorded represents an increment of 0.25 feet of filamentary material 29 wound on the mandrel 31A.

An encoder 33, which may be capable of encoding 360 pulses per spindle revolution, is connected to the spindle 31 by any means (e.g., direct, gears, belt, etc.). The pulses generated by the encoder 33 are counted by the controller 30 (FIG. 3) so that the rotational displacement of the mandrel 31A, and therefore the coil 35 on the mandrel 31A, is known (e.g., in degrees) between each length counter interrupt pulse. Thus, each time a length interrupt pulse is received, the current encoder pulse count is compared to the previous encoder pulse count to obtain a mandrel or coil displacement in degrees. The angular displacement of the mandrel 31A or coil 35 and the measured length of the filamentary material 29 between interrupt pulses can be used to measure a coil circumference, and thus a coil diameter, which is assumed to be constant between the current and previous encoder counts. For example, when the length counter 24 triggers the length counter interrupt, the controller 30 (FIG. 3) increments the measured length of the coil by 0.25 feet. The controller 30 (FIG. 3) also reads the current spindle count from the encoder 33 and subtracts the previous spindle count recorded at the same time as the previous length counter interrupt. In this example, that difference is 25 degrees. Therefore, 0.25 feet extends across 25 degrees of the coil circumference (360 degrees). Accordingly, the length of filamentary material 29 wound between the interrupt pulses (0.25 feet) is equal to approximately 0.069 (25/360) of the circumference of the coil. Thus, the circumference C of the coil between the length interrupts is approximately 3.63 feet or 43.48 inches and the coil diameter D (D=C/pi) is approximately 13.85 inches. This diameter measurement may be considered a constant between the interrupt pulses. It will be appreciated that as the resolution of the interrupt pulses increases, the coil diameter measurement converges toward a more instantaneous measurement of the coil diameter.

While the measurement of the coil diameter is more accurate than predicting the coil diameter based on coil layers and the diameter of the filamentary material, the measurement may still have limited inaccuracies due to the specifics of the winding system, as described in greater detail below.

For example, due to the reciprocating motion of the traverse 32 and other coil winding process operations, a buffer dancer 26 is placed in the system between the length counter 24 and the traverse 32, as shown in FIG. 2. In one embodiment, the buffer 26 includes movable block units that are spring loaded and contain sheaves 26A and 26B. As the traverse 32 reciprocates, it causes changes to the filamentary material line speed and length between the length counter and coil/mandrel surface. The action of the buffer 26 is to act against its springs 26C to cause the block and sheaves 26A and 26B to move closer or further apart in response to the length and speed changes caused by the winding process.

The operation of the buffer 26 can create complications in measuring the coil diameter because the distance from the length counter 24 and the surface of the coil 35 is continually changing. In one embodiment, the controller 30 (FIG. 3) may store the result of the spindle encoder count over several length interrupt pulses and average them so that a running average of the coil diameter is calculated and used in other calculations requiring knowledge of the coil diameter. In one embodiment, ten spindle encoder counts are averaged for a running average of the coil diameter. The result is a running average of the number of degrees that the length of filamentary material 29 subtends over one length counter interrupt pulse, which can be used to determine the coil diameter, as discussed above.

Another factor that can affect the accuracy of the measurement of the coil diameter is that the filamentary material 29 is wound in a figure-eight, which has a circuitous path around the coil and it is slightly longer than the actual circumference of the coil. This difference may be accounted for by applying a scaling factor to the calculated circumference (and therefore the diameter), such as by scaling it by 0.99 (a 1% reduction in the calculated value).

Once the coil diameter is measured (and/or scaled) as described herein, the coil diameter can be used to calculate and update the above-noted parameters: hole shift, hole taper, and density. For example, in U.S. Pat. No. 5,470,026, the entire contents of which are incorporated by reference herein, the coil diameter (D) is a variable in the following formulas to determine the payout hole diameter and hole angle "a" between wound material and centerline of coil at the payout hole. However, instead of predicting the coil diameter based on coil layer and filamentary material diameter (per-layer approach) as was done previously, the hole angle "a" can be continuously determined based on a real-time (running average) measurement of the coil diameter.

Figure 4:
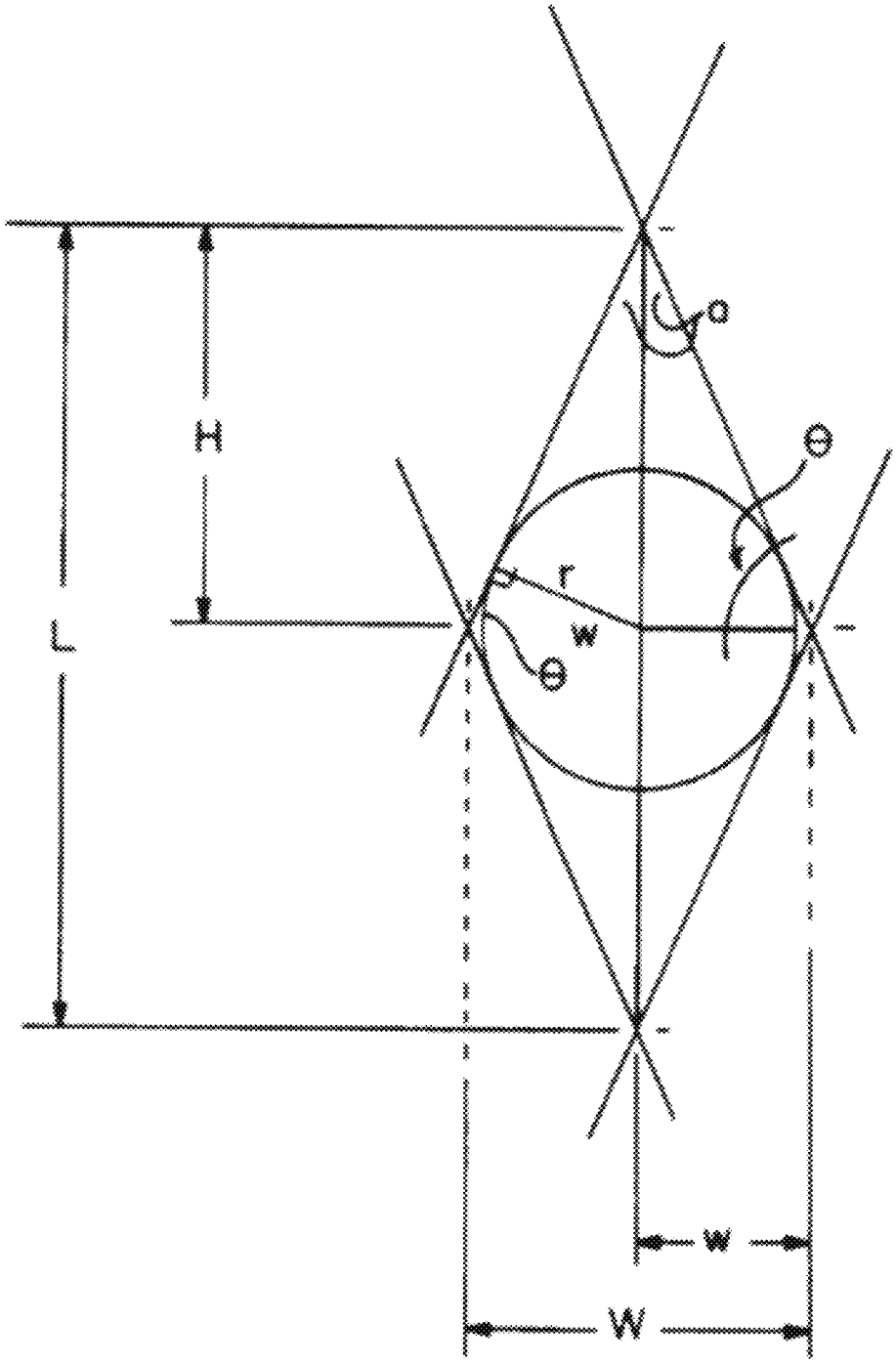
FIG. 4 shows the relationship between various parameters involved in generating a constant diameter payout hole during winding of a coil.

Since the diameter of the coil is known using the methods described above, the following equations can be solved as a system of equations to determine the angle "a", where the following variables and constants are used in the equations and are shown with reference to the payout hole shown in FIG. 4.

| | |
|---|---|
| $P_0$ | Initial payout hole size |
| P | Payout hole size |
| $M_w$ | Mandrel width |
| D | Mandrel/coil diameter |
| W | Width of payout hole |
| w | W/2 |
| r | Radius of payout tube |
| L | Length of payout hole |
| H | L/2 |
| a | Angle between wound filamentary material and centerline of coil at the payout hole |

Figure 5:
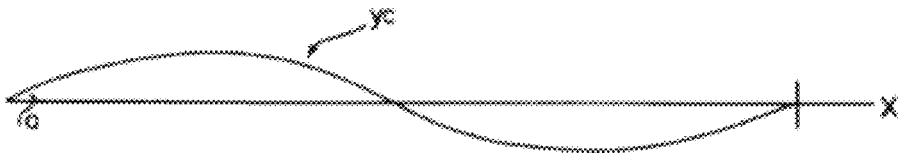
FIG. 5 is a graph of the relative displacement vs. total travel distance of the spindle for an arbitrary traverse motion.

In one embodiment, it is assumed that the traverse output is sinusoidal such that the coil pattern is also sinusoidal. The sinusoidal displacement is shown in FIG. 5 and is defined by the following equation:

$$Y_c=(M_w/2)\sin\{x/D\}, \tag{1}$$

where $Y_c$ is defined as the traverse displacement relative to a center position of the traverse and x is defined as the cumulative displacement of the traverse for a figure-eight.

$$a=\mathrm{Tan}^{-1}(y'_c), \tag{2}$$

where $$y'_c=dy_c/dx, \tag{3}$$

and $$y'_c=(M_w/2D)\cos\{x/D\}, \tag{4}$$

so that where $x=0$, equation (4) simplifies to $$y'_c=M_w/2D \tag{5}$$

Further, if the length of the payout hole (L) on the surface of the coil is known and the coil diameter is determined according to the methods described herein, then the payout hole angle P can be calculated from the following equation, $$P=360(L/D) \tag{6}$$

The remaining equations of the system of equations include:

$$(2r\tan\{90-\tan^{-1}(M_w/D)\})/\sin\{90-\tan^{-1}(M_w/D)\}=2r/\cos\{90-\tan^{-1}(M_w/D)\} \tag{7}$$

$$P=(720r)/D\cdot\cos\{90-\tan^{-1}(M_w/D)\} \tag{8}$$

$$r=D\cdot\cos\{90-\tan^{-1}(M_w/D)\}/720 \tag{9}$$

Equation (8) shows the relationship between the payout hole angle size (P), mandrel width ($M_w$), coil diameter (D), and payout tube radius (r). The coil diameter (D) used in equation (8) is measured according to the methods described herein. Using equation (8), the payout hole angle size (P) can be calculated continuously throughout the winding process.

In one embodiment, the payout hole opening size (L) is kept constant throughout the length of the payout hole. The following example method may be used to form the coil with the constant hole opening size. If an 8-inch diameter mandrel is used and a payout hole angle size is ninety (90) degrees, the opening (L) on the surface of the mandrel will be 6.28 inches. In order to produce a generally uniform diameter payout hole, with each layer of the coil, the payout hole angle size is reduced depending on the process's calculated coil diameter, as described above. If, by way of example, it is determined that the next layer diameter is determined to be 8.55 inches, then the corresponding hole angle size needed to maintain a 6.28 inch opening will be 84.2 degrees ((360·6.28)/(8.55·pi)), based on equation (6). Further, if the next measured diameter is 9.04 inches, then the payout hole angle size will be reduced to 79.6 degrees ((360·6.28)/(9.04·3.14)), and so on.

The density of the coil may also be improved as a result of accurately determining the coil diameter as described herein. As noted above, a common use of the density parameter is to maintain the spacing between the figure-eights essentially constant in each layer of the coil. The prior coil winding methods could not actually accomplish this due to the inaccuracies in the predicted coil diameter based on coil layer number and filamentary material diameter. The traverse speed offset is often specified by two parameters: an upper speed offset (also referred to as "upper ratio", and "plus advance") and a lower speed offset (also referred to as "lower ratio", and "minus advance"). The coil winding process uses the upper speed offset when winding the first (and odd numbered) layer of the coil, and uses the lower speed offset when winding the second (and even numbered) layer of the coil.

The following example illustrates the use of the upper speed offset and lower speed offset. The spacing between figure-eights in any layer of the coil can be calculated from the following equation:

$$\text{Spacing}=2\cdot\text{speed offset percentage}/100\cdot D\cdot\text{pi} \tag{10}$$

In the example, the upper speed offset is set to 3.5% and the lower speed offset is set to 3.2%. Also, for purposes of this example, the mandrel is assumed to have an 8-inch diameter, and the circumference and diameter of the coil are calculated about 100 times per second. Thus, for the first layer of the coil the spacing between figure-eights (e.g., in inches) is calculated based on the calculated coil/mandrel diameter and the initial upper speed offset of 3.5%. In this example, the spacing between figure-eights is calculated to be 1.76 inch (2·(3.5%/100)·8 inches·pi). For the second layer, when the process switches to the lower speed offset, the same calculation (e.g., equation (10)) is repeated, but the updated coil diameter is larger than the diameter used in the prior calculation (i.e., the initial diameter is equal to the mandrel diameter), because the first layer is in place and the second layer is wound on top of it. In this example, if the diameter of the second layer is determined to be 8.46 inches, the spacing between the figure-eights is 1.70 inch (2·3.2%/100·8.46 inches·pi). For the third layer in this example, the coil diameter may be calculated to be 8.92 inches. If the spacing between the figure-eights is to be maintained at 1.76 inch, then the upper speed offset must change from 3.5% to 3.1% (1.76 inch/2·8.92 inches·pi·100), based on solving equation (10) for speed offset. The offset, figure-eight spacings, and numbers of figure-eights per layer are listed in Table 2, below.

TABLE 2

| Layer | Offset (%) | Figure-Eight Spacing (inches) | Number of Figure-Eights |
|---|---|---|---|
| 1 | 3.5 | 1.76 | 14.28 |
| 2 | 3.2 | 1.70 | 15.63 |
| 3 | 3.14 | 1.74 | 15.92 |
| 4 | 2.88 | 1.71 | 17.33 |
| 5 | 2.85 | 1.79 | 17.56 |
| 6 | 2.63 | 1.68 | 19.03 |
| 7 | 2.60 | 1.76 | 19.21 |
| 8 | 2.41 | 1.69 | 20.73 |
| 9 | 2.40 | 1.76 | 20.85 |
| 10 | 2.23 | 1.68 | 22.43 |
| 11 | 2.22 | 1.74 | 22.49 |
| 12 | 2.07 | 1.72 | 24.13 |

Figure 6:
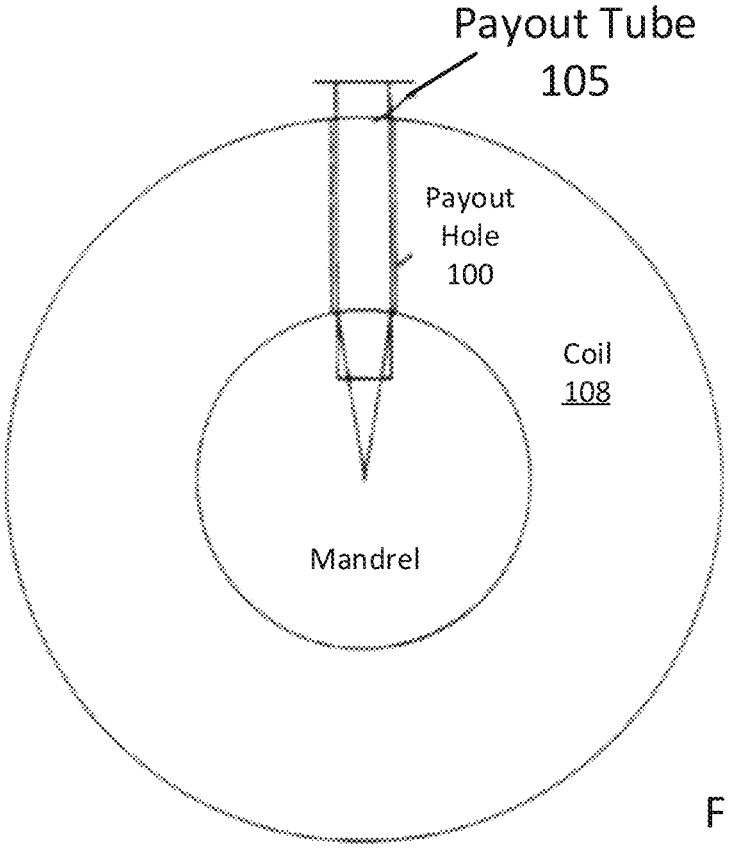
FIG. 6 shows a coil formed utilizing the winding apparatus of the disclosure and that has a straight payout hole.

A coil formed using the example dimensions as seen in FIG. 6 has a straight (radial) payout hole 100 that will not be influenced by the hole taper or density and that can receive a straight payout tube 105. The coil 108 formed using this method will be more stable than using prior methods, which tend to increase the number of figure-eights to much higher values in the outer layers.

While a constant diameter payout hole and constant figure-eight spacing are often desired when winding coils, there may be situations where it may be desired to produce coils with varying parameters. For example, it has long been known that certain high-speed data carrying cables can be damaged (damage to their transmission characteristics) as a result of how the wire is wound. More specifically with regard to Reelex coils, it is known that such damage can be caused even when the traverse speed offsets are set to values that are in a "normal" range for non-signal-carrying cables of similar diameter. When the cable is wound, it bends slightly at the crossover point of the figure-eight. If too many figure-eights are radially distributed around the circumference of the coil, the close proximity of the crossover points cause more severe bending of the cable, which can damage the cable. Thus, most of the damage occurs on the first, inner layers of wound cable. One solution to this problem has been to use a constant, very high traverse speed offset throughout the entire coil winding process. This solution produces coils that are larger than if the traverse speed offsets were lower. However, by knowing the diameter of the coil accurately using the methods and apparatuses described herein, it is possible to vary the traverse speed offset from a higher value when winding the inner layers to a lower value when winding the outer layers so that the inner layers are protected from excessive bending, without producing a coil with a diameter as large as prior art coils of equal length where the prior art coils are wound using a uniform, larger traverse speed offset. In addition, this can be accomplished without affecting the hole taper or hole shift.

In one example, a predefined traverse speed offset vs. coil diameter profile can be used to produce a coil with very high spacing between figure-eights for inner windings or layers of the coil and reduced spacing between figure-eights in the outer windings or layers of the coil. The profile can be implemented as a lookup table or a functional relationship to facilitate computer implementation. An example of a method to calculate speed offset vs. coil diameter is as follows. Assume a speed offset of 8% is desired for the inner layers and that the speed offset is to be proportionally decreased with coil diameter until the coil reaches 13 inches. After 13 inches, the coil will have constant figure-eight spacing of 1.76 inches. The formula for speed offset between coil diameter of 0 to 13 inches is:

$$\text{Speed offset}=6.2\cdot(13-D)/5+1.8. \quad (11)$$

Then, for diameters larger than 13 inches, the method of calculating the speed offset based on constant spacing between figure-eights, as described hereinabove can be implemented. A density profile (layer vs speed offset %) may thus be as shown in Table 3, below.

TABLE 3

| Layer | Speed Offset % |
|---|---|
| 1 | 8 |
| 2 | 7.4 |
| 3 | 6.9 |
| 4 | 5.7 |
| 5 | 5.1 |
| 6 | 4.6 |
| 7 | 4 |
| 8 | 3.4 |
| 9 | 2.9 |
| 10 | 2.3 |
| 11 | 2.2 |
| 12 | 2.1 |
| 13 | 2.1 |
| 14 | 2.0 |

With respect to the block diagrammatic illustration of a winding machine 10 as shown in FIG. 3, controller 30 can track the displacement of spindle 31 and traverse 32 with encoders 33 and 34, respectively, although other devices, such as potentiometers or resolvers, can be used. The necessary upper and lower speed offsets (e.g., ADVANCES) are entered either with an input device 30A such as thumbwheel switches, a keypad, computer keyboard, an internally stored data base, or downloaded from a database through serial communication (none shown in FIG. 3). The ADVANCES are calculated from the diameter of the filamentary material 29, the diameter of the mandrel 31A, and the distance of the traverse 32 from the surface of spindle 31. Various parameters of the winding process are displayed via a display 30B.

The controller 30 reads the position of the spindle 31 and traverse 32 and provides a reference signal 41 to the traverse motor 38 via the traverse drive 40 that results in an ADVANCE to the traverse 32. The controller 30 switches the sense of the ADVANCE (plus or minus) when it is time to make the payout hole in the winding. The aforementioned operations are known to those skilled in the winding art. The spindle motor 37 is controlled by spindle drive 42 by a reference signal 43 from the controller 30 in a manner known to the winding art.

The traverse 32 may be driven with a crank arm 35 and connecting rod 36. When such an arrangement of a crank arm 35 and connecting rod 36 is driven at a constant RPM (of the crank arm 35) by the traverse motor 38 and cam box 39, distortion may be created in the motion of the traverse 32. The cam box 39 may use an arrangement of cams to remove such distortion.

The controller 30 receives input of the respective position of the traverse motor 38 and the spindle motor 37 via encoders 34 and 33, respectively, through counter circuitry 44. Winding a coil with the programmed density may be carried out by either programming the controller 30 to solve equation (1) above, or to provide a "look-up" table (such as Table 3) in the computer so that the necessary ADVANCES can be provided to the traverse motor 38 and/or the spindle motor 37.

In one aspect, the winding machine 10 described herein should not be considered limited to the specific physical layout described. Some practical considerations for features of the winding machine are as follows. Mechanical cams may provide the most speed. Dual and single belt traverses may also be utilized. Electronic cams may provide a certain amount of flexibility, but may have speed limitations. DC motors can be used as well as AC motors, steppers or servos. The traverse 32, if driven by a mechanical cam, can be driven with a standard rotary motor (DC, AC, stepper, servo). Electronic cams can use a servo motor or linear motor.

In addition, it should be appreciated that the term "controller" should not be construed to limit the embodiments disclosed herein to any particular device type or system. The controller may include a computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. This memory may be used to store, for example, data from transmitted light signals, relative light signals, and output pressure signals.

Some of the methods and processes described above, as listed above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

The controller may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

There have been described and illustrated herein several embodiments of an apparatus and a method of winding filamentary material into coils. While particular embodiments have been described, it is not intended that the invention be limited thereto, as it is intended that the invention be as broad in scope as the art will allow and that the specification be read likewise. Thus, while particular types of devices have been disclosed for determining the length of filamentary material wound on a mandrel in a winding process, it will be appreciated that other length counting devices may be used as well. It will therefore be appreciated by those skilled in the art that yet other modifications could be made to the provided invention without deviating from its spirit and scope as claimed.

What is claimed is:

1. An apparatus for winding filamentary material, comprising:

a mandrel rotatable about a spindle axis of rotation and a traverse reciprocating at a distance with respect to said spindle axis to wind said filamentary material in a figure-eight coil configuration with a payout hole extending radially from the inner to the outer wind of said coil;

a measurement device for measuring the diameter of said coil as it is being wound around said mandrel, said measurement device including a diameter determination unit for determining the diameter of the coil based on a ratio of the length of filamentary material wound about said mandrel over a time period to the angular displacement of said mandrel over the time period; and a controller for controlling the reciprocating movement of said traverse with respect to the rotation of said mandrel based on the measured diameter of said coil to wind said filamentary material on said mandrel in said coil of said figure-eight configuration to form said payout hole having a constant diameter.

2. The apparatus according to claim 1, wherein:

said measurement device includes a first sensor configured to measure the length of filamentary material wound about said mandrel over the time period, and said first sensor includes an encoder configured to generate a series of pulses corresponding to the length of filamentary material wound about said mandrel.

3. The apparatus according to claim 2, further comprising:

a second sensor configured to the angular displacement of said mandrel over the time period, and wherein the second sensor includes an encoder configured to generate a series of pulses corresponding to the angular displacement of said mandrel during the winding of the length of filamentary material.

4. An apparatus for winding filamentary material, comprising:

a mandrel rotatable about a spindle axis of rotation and a traverse reciprocating at a distance with respect to said spindle axis to wind said filamentary material in a figure-eight coil configuration with a payout hole extending radially from the inner to the outer wind of said coil;

a measurement device for measuring the diameter of said coil as it is being wound around said mandrel, said measurement device including a first sensor configured to measure a length of filamentary material wound about said mandrel, and including a second sensor configured to measure an angular displacement of said mandrel during the winding of the length of filamentary material about said mandrel, said measurement device including a diameter determination unit for determining the diameter of the coil based on a ratio of the length of filamentary material wound about said mandrel over a time period and measured by said first sensor to the angular displacement of said mandrel over the time period and measured by said second sensor; and a controller for controlling the reciprocating movement of said traverse with respect to the rotation of said mandrel based on the measured diameter of said coil to wind said filamentary material on said mandrel in said coil of said figure-eight configuration to form said payout hole having a constant diameter.

5. The apparatus according to claim 1, wherein:

said first sensor includes an encoder configured to generate a series of pulses corresponding to the length of filamentary material wound about said mandrel.

6. The apparatus according to claim 5, wherein:

said second sensor includes an encoder configured to generate a series of pulses corresponding to the angular displacement of said mandrel.

7. The apparatus according to claim 6, wherein:

the diameter of the coil is based on the quantity of pulses generated by said second sensor between two consecutive pulses generated by said first sensor.

8. The apparatus according to claim 7, wherein:

the quantity of pulses generated by said second sensor is a running average of the number of degrees that the length of filamentary material subtends between the two consecutive pulses generated by said first sensor.

9. The apparatus according to claim 1, wherein:

said controller is configured to control the traverse to wind said filamentary material on said mandrel in said coil of said figure-eight configuration and form said payout hole having a straight configuration.

10. The apparatus according to claim 1, wherein:

said controller is configured to control the traverse such that the number of figure-eights in each layer of the coil increases from an inner layer of the coil to an outer layer of the coil.

11. The apparatus according to claim 10, wherein:

the number of figure-eights in each layer increases linearly from the inner to the outer layer of the coil.

12. The apparatus according to claim 10, wherein:

the number of figure-eights in each layer increases nonlinearly from the inner to the outer layer of the coil.

13. A method of winding filamentary material on a mandrel rotatable about a spindle axis of rotation and a traverse reciprocating at a distance with respect to said spindle axis to wind said filamentary material in a figure-eight coil configuration with a payout hole extending radially from the inner to the outer wind of said coil, comprising:

controlling the rotation of said mandrel about said spindle axis of rotation to wind filamentary material about said mandrel;

measuring the diameter of the coil as the filamentary material is being wound about said mandrel, said measuring including:

measuring a length of filamentary material wound about said mandrel over a time period; and measuring an angular displacement of said mandrel over the time period; and determining the diameter of the coil based on a ratio of the measured length of filamentary material wound about said mandrel to the measured angular displacement of said mandrel during the winding of the length of filamentary material about said mandrel; and controlling, based on the measurement of said diameter, the reciprocating movement of said traverse with respect to the rotation of said mandrel to wind said filamentary material on said mandrel to form said payout hole having a constant diameter.

14. The method according to claim 13, wherein:

said controlling the reciprocating movement of said traverse includes winding said filamentary material on said mandrel in said coil of said figure-eight configuration to form said payout hole having a straight configuration.

15. The method according to claim 13, wherein:

said controlling the reciprocating movement of said traverse includes winding said filamentary material on said mandrel in said coil of said figure-eight configuration such that the number of figure-eights in each layer of the coil increases from an inner layer to an outer layer of the coil.

16. The method according to claim 15, wherein:

the number of figure-eights in each layer increases linearly from the inner to the outer layer of the coil.

17. The method according to claim 15, wherein:

the number of figure-eights in each layer increases nonlinearly from the inner to the outer layer of the coil.

* * * * *